US007604512B1

(12) United States Patent
Chen

(10) Patent No.: US 7,604,512 B1
(45) Date of Patent: Oct. 20, 2009

(54) FEMALE USB CONNECTOR

(75) Inventor: Po-Jung Chen, Taoyuan (TW)

(73) Assignee: U.D. Electronic Corp., Taoyuan (TW)

( * ) Notice: Subject to any disclaimer, the term of this patent is extended or adjusted under 35 U.S.C. 154(b) by 0 days.

(21) Appl. No.: 12/414,673

(22) Filed: Mar. 31, 2009

(51) Int. Cl.
*H01R 24/00* (2006.01)

(52) U.S. Cl. ..... 439/660

(58) Field of Classification Search ..... 439/660, 439/79, 80

See application file for complete search history.

(56) References Cited

U.S. PATENT DOCUMENTS 7,517,253 B1 * 4/2009 Chiang ..... 439/660

2009/0111330 A1 * 4/2009 Lin et al. ..... 439/638

* cited by examiner

*Primary Examiner*—Phuong K Dinh

(57) ABSTRACT

A high stability and EMI protective female USB connector is disclosed to include an electrically insulative base member, which holds a set of first metal terminals in a top abutment portion thereof and has two locating blocks at two sides of the top abutment portion, an insulative tongue plate, which holds a set of second metal terminals and has a bottom accommodation space that accommodates the top abutment portion of the insulative base member and two hook blocks disposed at two sides and respectively hooked up with the locating blocks of the insulative base member, an insulative terminal holder block fastened to the rear side of the insulative base member to hold the rear bonding portions of the first and second metal terminals in an array, and a metal shielding shell surrounding the insulative base member and the insulative tongue plate for grounding to provide excellent EMI protection.

11 Claims, 9 Drawing Sheets

FEMALE USB CONNECTOR

BACKGROUND OF THE INVENTION

1. Field of the Invention

The present invention relates to USB (Universal Serial Bus) connectors and more particularly, to a female USB connector, which has a set of first metal terminals and a set of second metal terminals respectively mounted in an electrically insulative base member and an electrically insulative tongue plate to avoid signal transmission interference. The electrically insulative base member and the electrically insulative tongue plate are fastened together by means of a hook joint, simplifying installation.

2. Description of the Related Art

Following fast development of modern electronic technology, advanced consumer electronic products have been continuously created and are intensively used in our daily living for different applications. Nowadays, people use a portable notebook to substitute for a deck computer. These advanced electronic products may use a transmission cable for transmitting photos, files, programs and other data. For the transmission of data, data transmission speed is quite important. Nowadays, USB (Universal Serial Bus) interfaces are most commonly used in consumer electronic products for the advantage of hog plug function.

USB 1.1 was currently used to power our mice, scanners, printers, MP3 and many other peripherals. USB2.0 is a currently used standard that operates at 480 Mbps, about 40× times faster than USB 1.1 which currently works at just 12 Mbps. However, USB2.0 is simply suitable for powering peripheral apparatus that consume less power (such as card reader, printer, memory stick, network phone and network camera). A new generation of USB3.0 helps the users to transfer data at 10× speed compared to USB2.0. It facilitates users to download data up to 4.8 Gbits/sec (Super-Speed mode), making users much comfortable transferring the data for high-end devices such as HD videos and high resolution pictures. Typical USB3.0 based applications are removable hard drives, flash drives, high-end video and imaging devices, HDTV displays, high-resolution printer/scanner, etc. USB3.0 is compatible to USB2.0. Further, it supports full duplex, providing for an increase in power output from 100 mA to 900 mA. A USB 3.0 connector is noticeably different to its USB 2.0 counterpart. By means of extra contacts, a USB3.0 connector allows data to be sent and received at the same time.

FIG. 9 illustrates a USB2.0 female connector according to the prior art. According to this design, the USB2.0 female connector comprises an electrically insulative base member A that has defined therein a plurality of terminal slots A1, a plurality of metal terminals B respectively positioned in the terminal slots A1 in the electrically insulative base member A, and a metal shielding shell C that surrounds the electrically insulative base member A. Each metal terminal B has a rear bonding portion B1 extended out of the electrically insulative base member A for bonding to an external circuit board, and a front contact portion B2 suspending inside the electrically insulative base member A for the contact of one corresponding metal terminal of the matching male USB connector.

Based on the design of the aforesaid USB2.0 female connector, extra metal terminals may be installed in the electrically insulative base member A to constitute a USB3.0 female connector. However, due to limited internal space, it is difficult to install a row of extra metal terminals in the electrically insulative base member A. Further, when a big number of metal terminals are installed in the electrically insulative base member A, signal transmission interference may occur, lowering the signal transmission quality or resulting in a transmission interruption.

SUMMARY OF THE INVENTION

The present invention has been accomplished under the circumstances in view. It is one object of the present invention to provide a female USB connector, which avoids transmission interference and provides excellent EMI protection, assuring signal transmission stability.

To achieve this and other objects of the present invention, a female USB connector comprises an electrically insulative base member, a set of first metal terminals mounted in the electrically insulative base member, an electrically insulative tongue plate mounted on the top side of the electrically insulative base member, a set of second metal terminals mounted in the electrically insulative tongue plate and electrically isolated from the set of first metal terminals, and a metal shielding shell surrounding the electrically insulative base member and the electrically insulative tongue plate. The electrically insulative base member comprises an abutment portion for abutting against a matching male USB connector upon insertion of the matching male USB connector into the metal shielding shell, a plurality of terminal grooves formed in the abutment portion for the positioning of the first metal terminals, and two locating blocks respectively protruded from two opposite lateral sidewalls of the abutment portion. The electrically insulative tongue plate comprises a bottom accommodation space that accommodates the abutment portion of the electrically insulative base member, a plurality of elongated ribs longitudinally protruded from the bottom wall thereof in a parallel manner and suspending in the bottom accommodation space, a plurality of terminal grooves formed in the bottom wall between each two adjacent elongated ribs for the positioning of the second metal terminals, and two hook blocks protruded from the bottom wall and suspending at two opposite lateral sides of the bottom accommodation space for engagement with the locating blocks of the electrically insulative base member.

DETAILED DESCRIPTION OF THE PREFERRED EMBODIMENT

Figure 1:
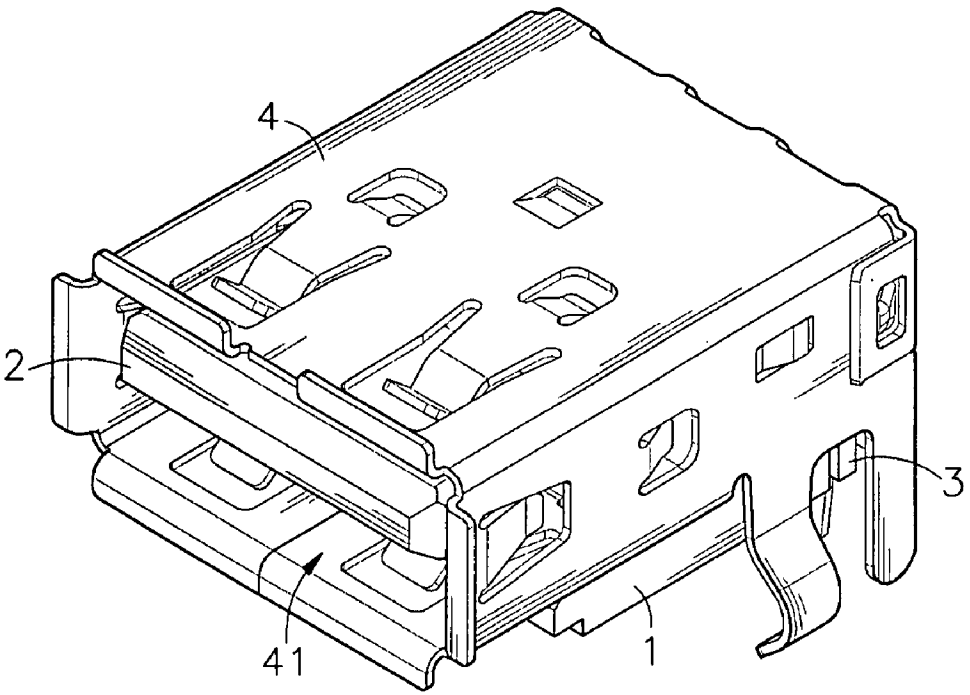
FIG. 1 is an oblique elevational view of a female USB connector in accordance with the present invention.
Figure 2:
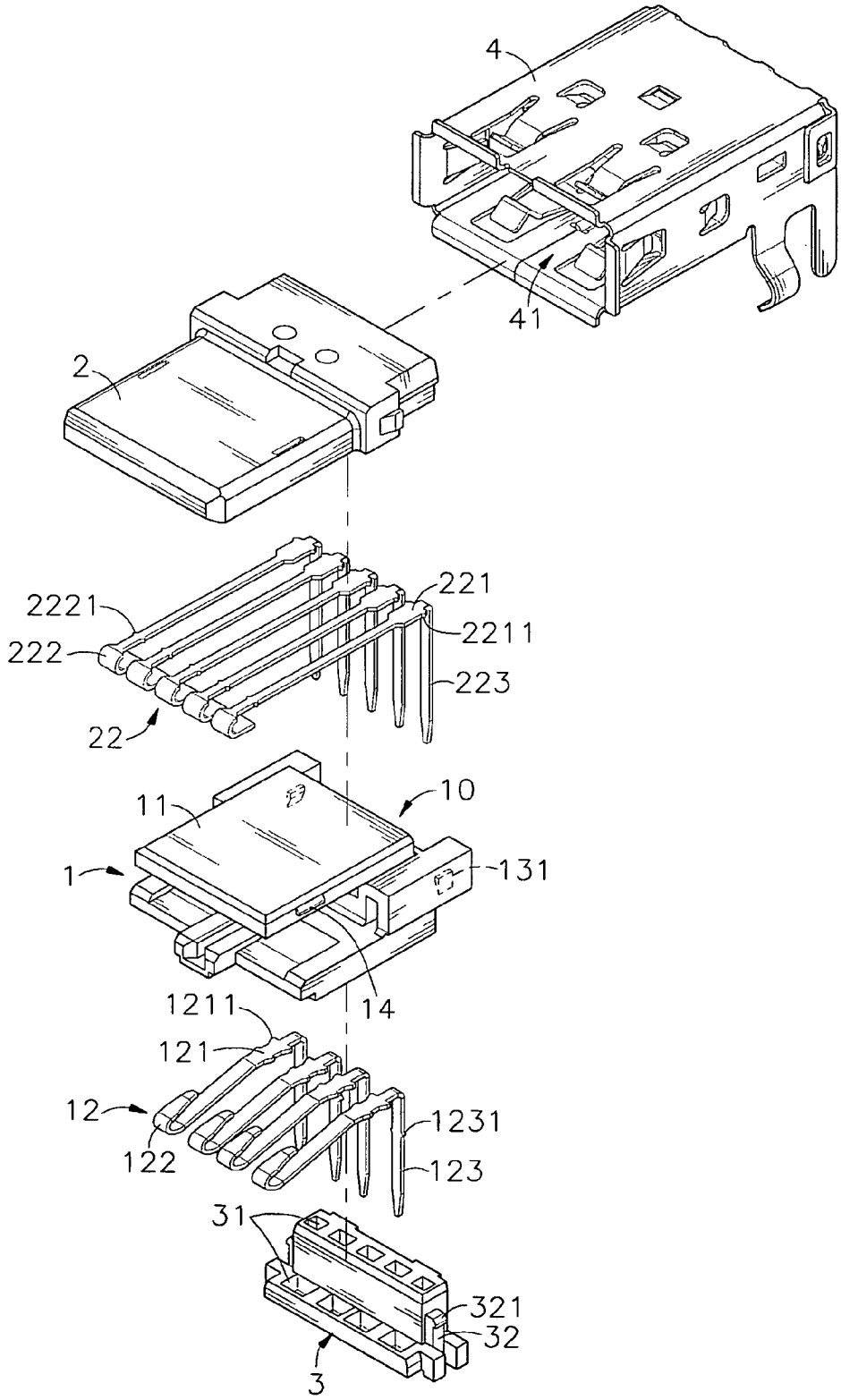
FIG. 2 is an exploded view of the female USB connector in accordance with the present invention.
Figure 3:
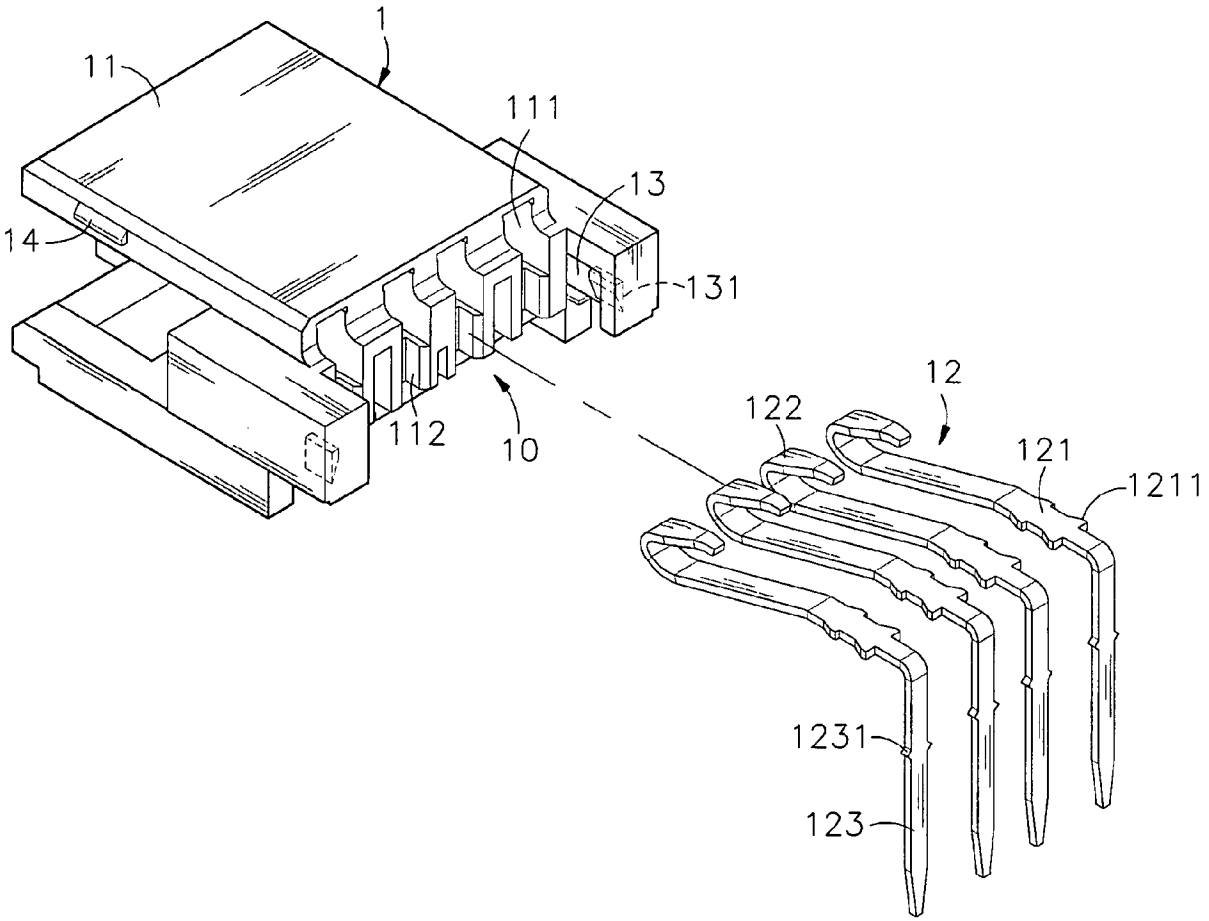
FIG. 3 is an exploded view of a part of the present invention, showing the structure of the electrically insulative base member and the first metal terminals.
Figure 4:
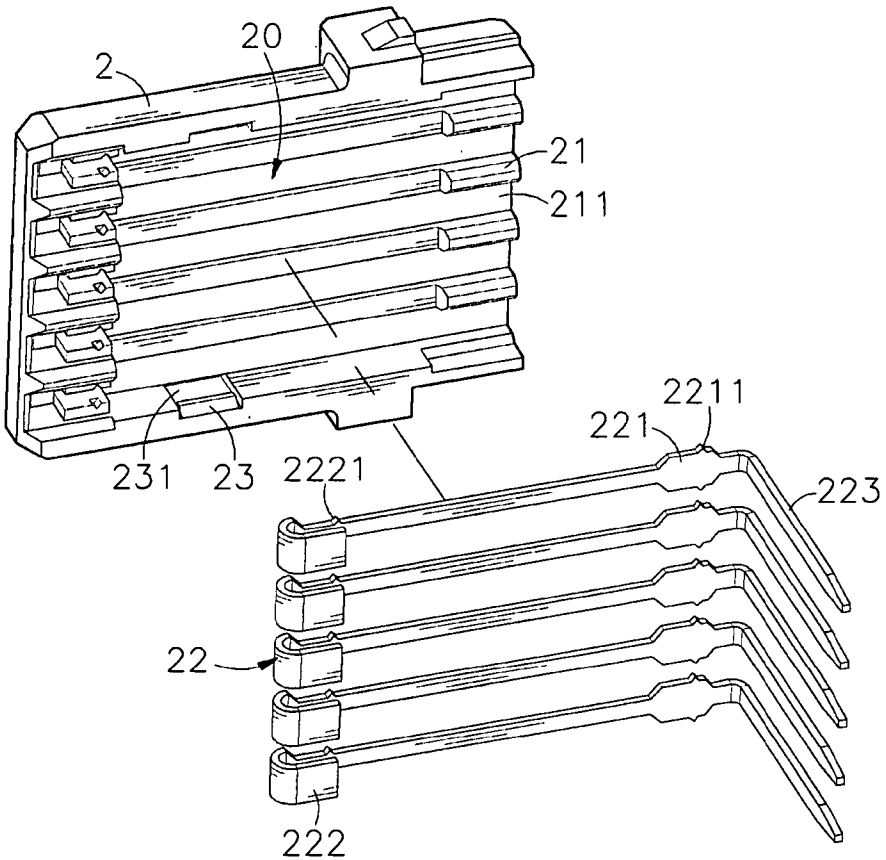
FIG. 4 is an exploded view of a part of the present invention, showing the structure of the electrically insulative tongue plate and the second metal terminals.

Referring to FIGS. 1~4, a female USB connector in accordance with the present invention is shown comprising an electrically insulative base member 1, a set of first metal terminals 12, an electrically insulative tongue plate 2, a set of second metal terminals 22, an electrically insulative terminal holder block 3, and a metal shielding shell 4.

The electrically insulative base member 1 comprises an abutment portion 11, a terminal holder block positioning space 10 defined in a rear side of the abutment portion 11, a plurality of horizontal terminal grooves 111 formed inside the abutment portion 11 in a parallel manner, a plurality of vertical terminal grooves 112 formed in the rear side of the abutment portion 11 in a parallel manner and respectively downwardly extending from the rear ends of the horizontal terminal grooves 111, two locating grooves 13 formed in the rear side of the abutment portion 11 and symmetrically disposed at two opposite lateral sides relative to the terminal holder block positioning space 10, a retaining protrusion 131 respectively disposed in each of the locating grooves 13, and two locating blocks 14 respectively protruded from two opposite lateral sidewalls of the abutment portion 11.

The first metal terminals 12 are respectively mounted in the abutment portion 11 of the electrically insulative base member 1, each having a base portion 121 respectively positioned in the horizontal terminal grooves 111 of the electrically insulative base member 1, a front contact portion 122 horizontally forwardly extended from one side, namely, the front side of the base portion 121 and suspending inside the electrically insulative base member 1 below the bottom wall of the abutment portion 11, a rear bonding portion 123 vertically downwardly extended from an opposite side, namely, the rear side of the of the base portion 121 and respectively inserted through the vertical terminal grooves 112 of the electrically insulative base member 1, and a plurality of barbs 1211 and 1231 respectively protruded from two opposite lateral sides the base portion 121 and rear bonding portion 123 of the first metal terminals 12 and respectively forced into friction engagement with the peripheral walls of the horizontal terminal grooves 111 and vertical terminal grooves 112 of the electrically insulative base member 1.

The electrically insulative tongue plate 2 is mounted on the top side of the electrically insulative base member 1, having a bottom accommodation space 20 for accommodating the abutment portion 11 of the electrically insulative base member 1, a plurality of elongated ribs 21 longitudinally protruded from the bottom wall thereof in a parallel manner and suspending in the bottom accommodation space 20, a plurality of terminal grooves 211 formed in the bottom wall between each two adjacent elongated ribs 21 for the positioning of the second metal terminals 22, and two hook blocks 23 protruded from the bottom wall and suspending at two opposite lateral sides of the bottom accommodation space 20 corresponding to the locating blocks 14 of the electrically insulative base member 1. Each hook block 23 defines a hook hole 231 for engagement with the associating locating block 14.

The second metal terminals 22 are mounted in the electrically insulative tongue plate 2, each having a base portion 221 respectively positioned in the terminal grooves 211 of the electrically insulative tongue plate 2, a front contact portion 222 forwardly extended from one end, namely, the front end of the base portion 221 and projecting into the bottom accommodation space 20, a rear bonding portion 223 vertically downwardly extended from an opposite side, namely, the rear side of the of the base portion 221 and respectively spaced behind the rear bonding portions 123 of the first metal terminals 12, and a plurality of barbs 2211 and 2221 respectively protruded from two opposite lateral sides of the base portion 221 and front contact portion 222 of the second metal terminals 22 and respectively forced into friction engagement with the peripheral walls of the terminal grooves 211.

The electrically insulative terminal holder block 3 is a stepped block, having two rows of terminal slots 31 vertically cut through the top and bottom sides thereof for the passing of the rear bonding portions 123 of the first metal terminals 12 and the rear bonding portions 223 of the second metal terminals 22, and two positioning blocks 32 respectively protruded from two opposite lateral sides thereof and respectively fitted into the locating grooves 13 of the electrically insulative base member 1. Each positioning block 32 has a hook portion 321 respectively forced into engagement the retaining protrusions 131 in the locating grooves 13 of the electrically insulative base member 1.

The metal shielding shell 4 is a box-like metal shell defining therein a receiving chamber 41 that receives the electrically insulative base member 1 and the electrically insulative tongue plate 2.

Figure 5:
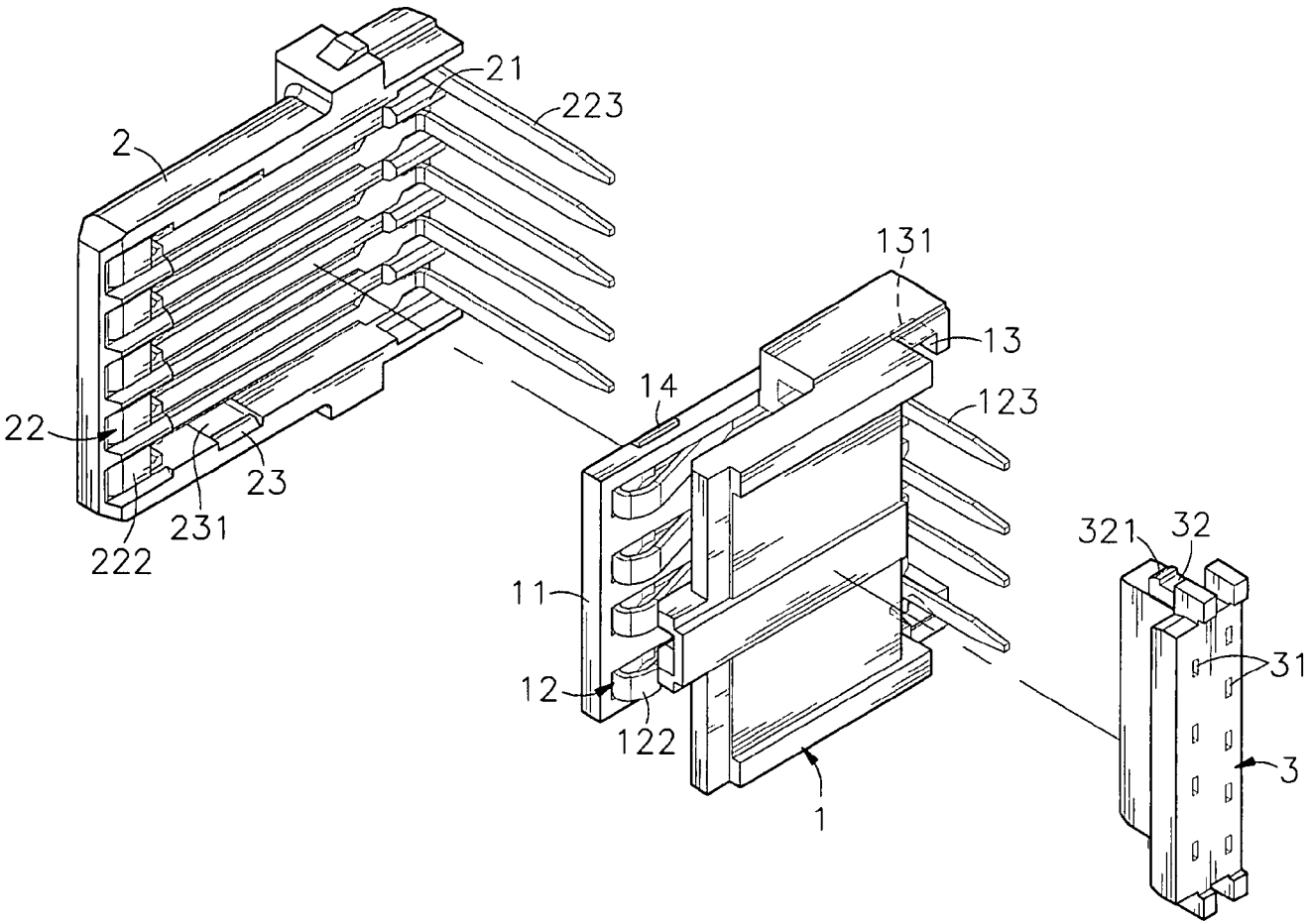
FIG. 5 illustrates the first metal terminals and the second metal terminals respectively installed in the electrically insulative base member and the electrically insulative tongue plate before connection of the electrically insulative tongue plate and the electrically insulative terminal holder block to the electrically insulative base member.
Figure 6:
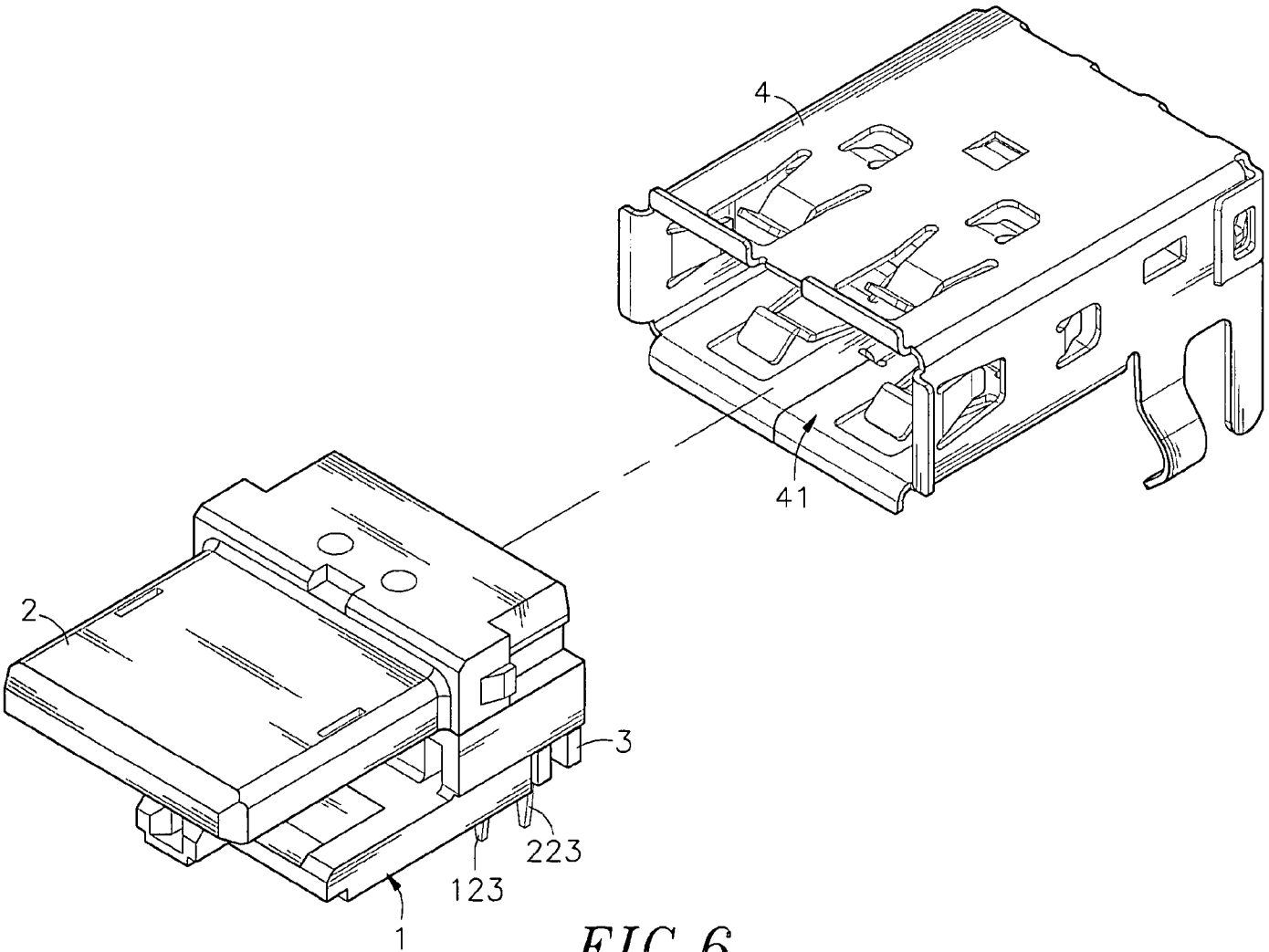
FIG. 6 is an assembly view of the present invention before installation of the metal shielding shell.
Figure 7:
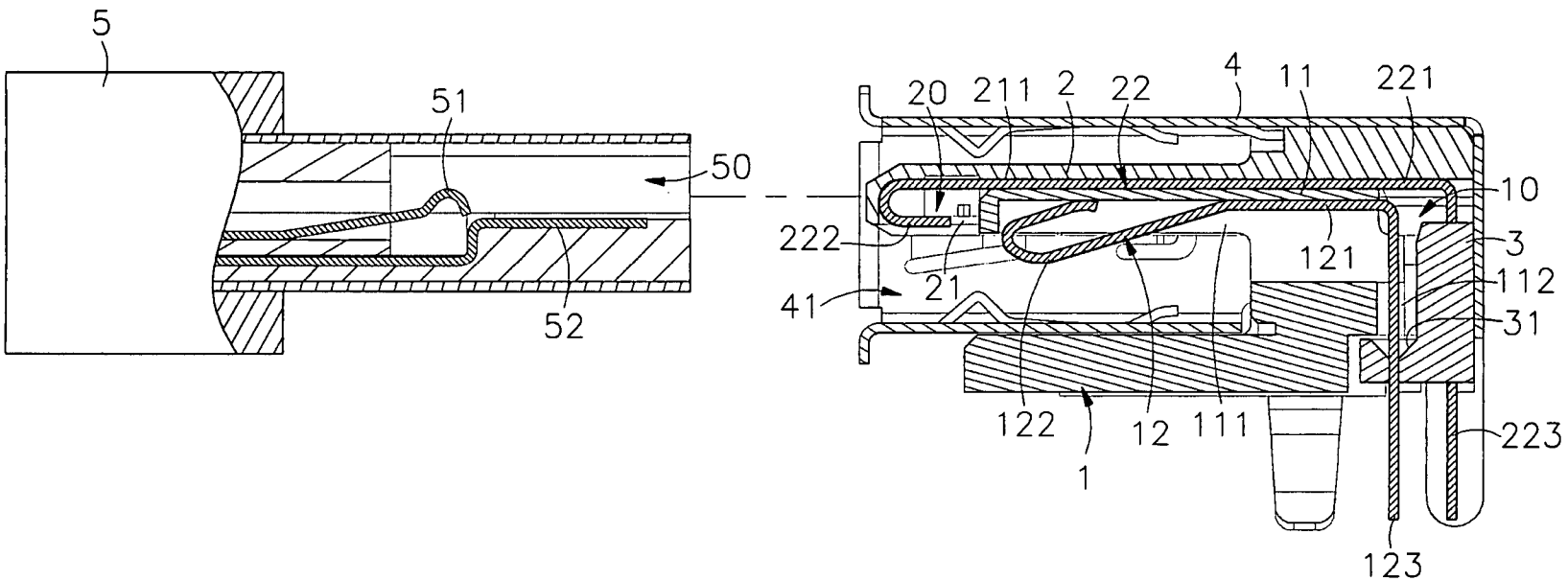
FIG. 7 is a schematic sectional view of the female USB connector and a matching male USB connector according to the present invention.
Figure 8:
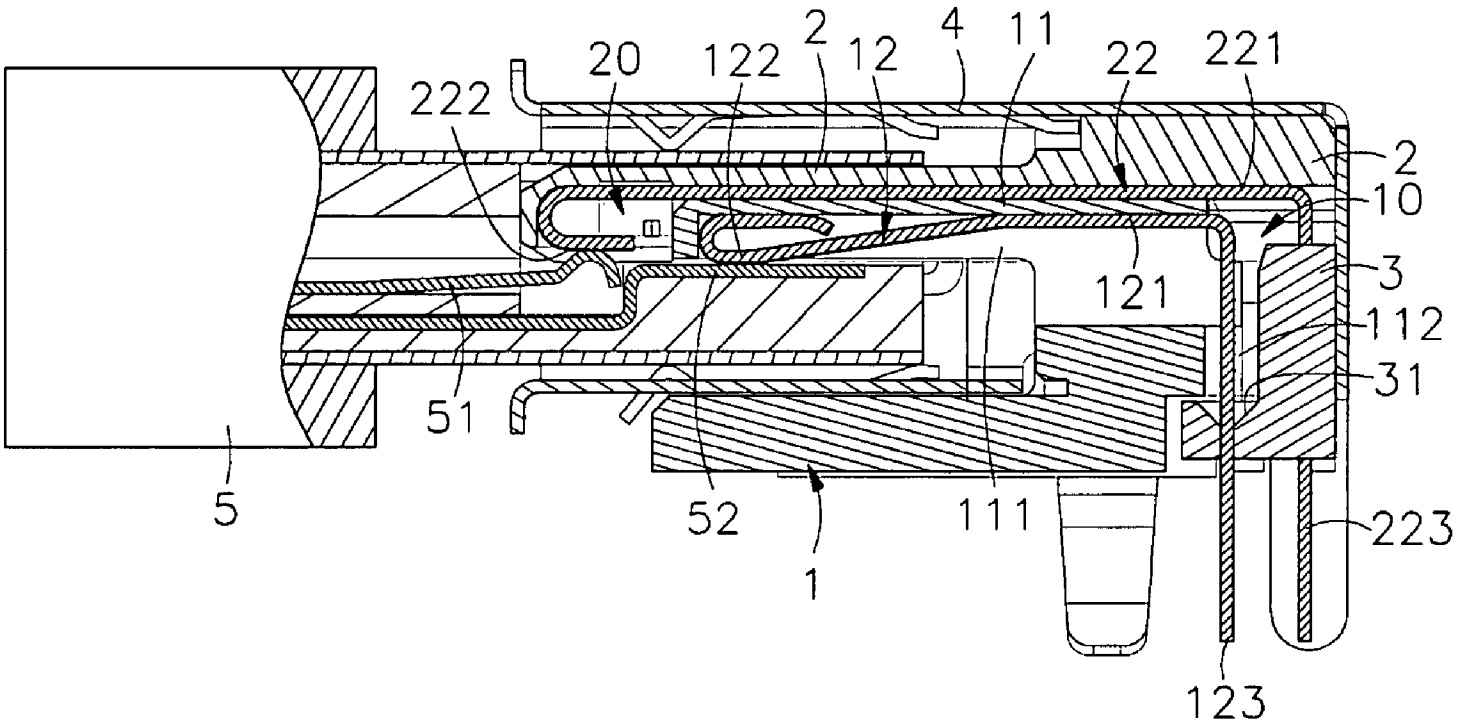
FIG. 8 corresponds to FIG. 7, showing the male USB connector connected to the female USB connector.
Figure 9:
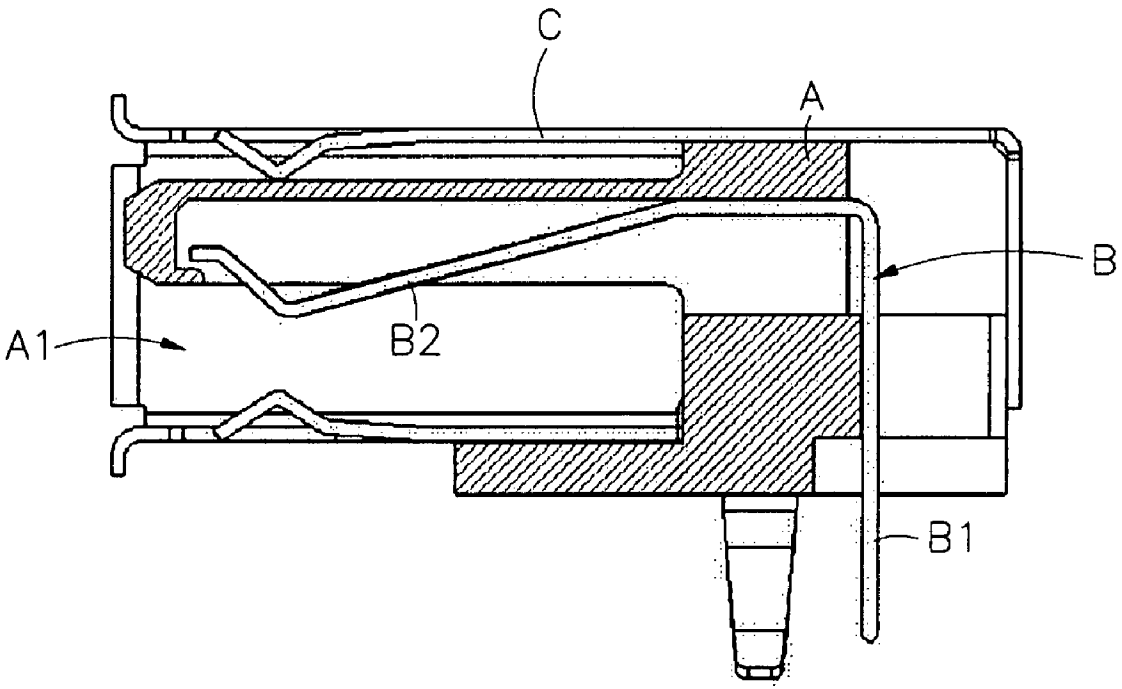
PRIOR ART FIG. 9
FIG. 9 is a sectional view of a female USB connector according to the prior art.

Referring to FIGS. 5 through 8, after installation of the first metal terminals 12 in the electrically insulative base member 1 and installation of the second metal terminals 22 in the electrically insulative tongue plate 2, insert the abutment portion 11 into the bottom accommodation space 20 of the electrically insulative tongue plate 2 to force the locating blocks 14 into engagement with the hook holes 231 of the hook blocks 23 of the electrically insulative tongue plate 2, and then insert the electrically insulative terminal holder block 3 into the terminal holder block positioning space 10 of the electrically insulative base member 1 to force the positioning blocks 32 into the locating grooves 13 of the electrically insulative base member 1 and to have the hook portions 321 of the positioning blocks 32 be respectively forced into engagement with the retaining protrusions 131 and the rear bonding portions 123 and 223 of the first metal terminals 123 and second metal terminals 223 be respectively inserted through the terminal slots 31 of the electrically insulative terminal holder block 3 for bonding to an external circuit board (not shown), and then mount the assembly of the electrically insulative base member 1, electrically insulative tongue plate 2 and metal terminals 12 and 22 in the receiving chamber 41 of the metal shielding shell 4.

According to the present invention, the electrically insulative base member 1 and the electrically insulative tongue plate 2 are fastened together by means of engagement between the locating blocks 14 and the hook blocks 23. Alternatively, a tenon and mortise joint or dovetail tongue and groove joint may be used to substitute for the engagement structure of the locating blocks 14 and hook blocks 23 for connection between the electrically insulative base member 1 and the electrically insulative tongue plate 2. The electrically insulative base member and the electrically insulative tongue plate are fastened together by means of a hook joint. This connection method facilitates the fabrication of the female USB connector and increases the yield rate. When assembled, the female USB connector shows high structural stability, facilitating positive plugging and deplugging of the matching male USB connector.

During application of the present invention and after installation of the female USB connector in a circuit board (not shown) of an electronic apparatus, for example, personal computer (not shown), a matching male USB connector 5 of a computer peripheral apparatus (not shown) is inserted into the receiving chamber 41 of the metal shielding shell 4 to have the electrically insulative tongue plate 2 be forced into the insertion space 50 of the male USB connector 5, thereby keeping the upper metal terminals 51 and lower metal terminals 52 of the male USB connector 5 in positive contact with the front contact portions 122 and 222 of the first metal terminals 12 and second metal terminals 22 of the female USB connector respectively. Thus, the personal computer and the computer peripheral apparatus are linked by the female USB connector of the present invention and the male USB connector for two-way data transmission.

As stated above, the invention provides a female USB connector, which comprises an electrically insulative base member 1 having an abutment portion 11, an electrically insulative terminal holder block 3 fastened to the rear side of the abutment portion 11 of the electrically insulative base member 1, a set of first metal terminals 12 mounted in the abutment portion 11 of the electrically insulative base member 1 and vertically downwardly inserted through the electrically insulative terminal holder block 3 for bonding to an external circuit board, an electrically insulative tongue plate 2, which defines a bottom accommodation space 20 that accommodates the abutment portion 11 of the electrically insulative base member 1, a set of second metal terminals 22 mounted in the electrically insulative tongue plate 2 and vertically downwardly inserted through the electrically insulative terminal holder block 3 for bonding to the same circuit board, and a metal shielding shell 4 that surrounds the electrically insulative tongue plate 2, the electrically insulative base member 1 and the electrically insulative terminal holder block 3 for EMI (electromagnetic interference) protection.

Although a particular embodiment of the invention has been described in detail for purposes of illustration, various modifications and enhancements may be made without departing from the spirit and scope of the invention. Accordingly, the invention is not to be limited except as by the appended claims.

What the invention claimed is:

1. A female USB connector comprising an electrically insulative base member, a set of first metal terminals mounted in said electrically insulative base member, an electrically insulative tongue plate mounted on a top side of said electrically insulative base member, a set of second metal terminals mounted in said electrically insulative tongue plate and electrically isolated from said set of first metal terminals, wherein:

said electrically insulative base member comprises an abutment portion for abutting against a matching male USB connector upon insertion of the matching male USB connector into a metal shielding shell, a plurality of terminal grooves formed in said abutment portion for the positioning of said first metal terminals, and two locating blocks respectively protruded from two opposite lateral sidewalls of said abutment portion;

said electrically insulative tongue plate comprises a bottom accommodation space for accommodating said abutment portion of said electrically insulative base member, a plurality of elongated ribs longitudinally protruded from a bottom wall thereof in a parallel manner and suspending in said bottom accommodation space, a plurality of terminal grooves formed in the bottom wall between each two adjacent elongated ribs for the positioning of said second metal terminals, and two hook blocks protruded from the bottom wall and suspending at two opposite lateral sides of the bottom accommodation space for engagement with the locating blocks of said electrically insulative base member.

2. The female USB connector as claimed in claim 1, wherein each said first metal terminal comprises a base portion respectively positioned in the terminal grooves of said electrically insulative base member, a front contact portion horizontally forwardly extended from one side of the base portion and suspending inside said electrically insulative base member below the bottom wall of said abutment portion, a rear bonding portion vertically downwardly extended from an opposite side of the base portion for bonding to an external circuit board.

3. The female USB connector as claimed in claim 2, wherein each said first metal terminal further comprises a plurality of barbs bilaterally protruded from the base portion and rear bonding portion for friction engagement with the peripheral wall of the associating terminal groove of said electrically insulative base member.

4. The female USB connector as claimed in claim 1, further comprising an electrically insulative terminal holder block fastened to the rear side of said abutment portion of said electrically insulative base member for holding the rear bonding portions of said first metal terminals and said second metal terminals in an array, said electrically insulative terminal holder block comprising two rows of vertically extending terminal slots for the passing of the rear bonding portions of said first metal terminals and said second metal terminals.

5. The female USB connector as claimed in claim 4, wherein said electrically insulative base member comprises a terminal holder block positioning space defined in the rear side of said abutment portion, two locating grooves formed in the rear side of said abutment portion and symmetrically disposed at two opposite lateral sides relative to said terminal holder block positioning space, and a retaining protrusion respectively disposed in each of said locating grooves; said electrically insulative terminal holder block comprises two positioning blocks respectively protruded from two opposite lateral sides thereof and respectively fitted into the locating grooves of said electrically insulative base member, each said positioning block comprising a hook portion respectively forced into engagement the retaining protrusion in each of the locating grooves of said electrically insulative base member.

6. The female USB connector as claimed in claim 4, wherein said electrically insulative terminal holder block is a stepped block.

7. The female USB connector as claimed in claim 1, wherein each said second metal terminals comprises a base portion respectively positioned in the terminal grooves of said electrically insulative tongue plate, a front contact portion forwardly extended from one side of the base portion and projecting into said bottom accommodation space, a rear bonding portion vertically downwardly extended from an opposite side of the base portion for bonding to an external circuit board, and a plurality of barbs respectively protruded from two opposite lateral sides of the base portion and front contact portion of the respective second metal terminals and respectively forced into friction engagement with the peripheral walls of the terminal grooves of said electrically insulative tongue plate.

8. The female USB connector as claimed in claim 1, wherein each said hook block of said electrically insulative tongue plate defines a hook hole for engagement with the associating locating block of said electrically insulative base member.

9. The female USB connector as claimed in claim 1, further comprising a metal shielding shell surrounding said electrically insulative base member and said electrically insulative tongue plate.

10. The female USB connector as claimed in claim 1, wherein said locating block and said hook block are fastened together by means of a tenon and mortise joint.

11. The female USB connector as claimed in claim 1, wherein said locating block and said hook block are fastened together by means of a dovetail tongue and groove joint.

* * * * *